United States Patent [19]

Ustin

[11] 4,080,030

[45] Mar. 21, 1978

[54] LAMPHOLDER SEAL

[75] Inventor: George Ustin, Tuckahoe, N.Y.

[73] Assignee: North American Philips Corporation, New York, N.Y.

[21] Appl. No.: 760,164

[22] Filed: Jan. 17, 1977

[51] Int. Cl.[2] ..... H01R 33/08

[52] U.S. Cl. ..... 339/50 S; 339/94 L

[58] Field of Search ..... 339/50 S, 94 R, 94 A, 339/94 C, 94 L, 94 M

[56] References Cited

U.S. PATENT DOCUMENTS

| | | | |
|---|---|---|---|
| 3,111,353 | 11/1963 | Nelson | 339/50 S |
| 3,955,871 | 5/1976 | Kruger | 339/94 R |

FOREIGN PATENT DOCUMENTS

| | | | |
|---|---|---|---|
| 694,957 | 8/1940 | Germany | 339/94 R |
| 471,979 | 7/1952 | Italy | 339/94 R |

*Primary Examiner*—Mark S. Bicks

*Attorney, Agent, or Firm*—Frank R. Trifari; David R. Treacy

[57] ABSTRACT

A sealing ring in a lamp socket face, particularly a fluorescent lampholder. A resilient ring is pressed into an undercut groove molded into the socket face, with an interference fit, the front of the ring protruding from the socket to seal against the lamp end.

7 Claims, 2 Drawing Figures

LAMPHOLDER SEAL

BACKGROUND OF THE INVENTION

1. Field of the Invention

This invention relates to lampholders for lamps having a sealing surface between the holder and the lamp, surrounding the electrical connection portion, and more particularly to lampholders for in-line fluorescent lamps held under axial pressure between two holders.

2. Description of the Prior Art

Electric lamps used in outdoor locations or other places exposed to high humidity, or to vapors having conducting or corrosive properties, require sealing of the space in which the lamp terminals make electrical connection with the contact fingers or surfaces of the lamp socket if long, reliable operation is to be obtained. Maintenance of this seal is a special problem with fluorescentlamps because of their unusually long, slim tubes having a separate connection at each end. Because of this configuration, there is a great tolerance build up between the ends so sealing is difficult.

The U.S. Pat. to G. A. Nelson, No. 3,111,353 issued Nov. 19, 1963, discloses a fluorescent lampholder having a rubber sealing ring placed in a groove in the face of a dielectric body, the ring having a surface protruding to contact and seal against the end of a tube inserted in the socket. Pressure exerted between a fixed socket at one end, and a spring-loaded plunger socket at the other, hold the sealing rings at each end in place. This design, however, had the two-fold disadvantage that the sealing rings did not always make a tight seal because of mis-alignment between the face of the dielectric and the tube end; and while attempting to insert one end of a long tube, an installer would easily dislodge the ring so that it came out of the groove and dropped un-noticed.

More recently, U.S. Pat. No. 3,384,858 issued May 21, 1968 to G. Johnson describes a lampholder having a resilient ring cemented to the front walls of the fixed lampholder and the compressible lampholder. This cementing alleviated the problem of accidental dislodging of the ring. A later filed application by Johnson resulted in issuance of U.S. Pat. No. 3,353,140 on Nov. 14, 1967, which teaches cementing the sealing ring, and further discloses the incorporation of a tilting capability in both lampholders so that mis-alignments would be compensated for. Lampholders of this general design have been in commercial use since then. However, because of the properties of the materials used, it has been found that after prolonged use, these cement grips between the sealing ring and the lampholder may become severely weakened or lost, so that the ring does not adhere to the lampholder. In fact, in some instances the ring adheres to the fluorescent lamp itself, a phenomenon believed due to migration of the hardening component used in the cement. This has the particular drawback that the installer will not notice the ring falling from the lampholder, and will be unware that the contacts will become exposed to corrosion.

SUMMARY OF THE INVENTION

The object of the invention is to provide an inexpensive lampholder which seals reliably to a lamp without dependence on a cement.

According to the invention, in a lampholder having a face aligned opposite a sealing surface of a lamp inserted into the socket, and a groove in the face in which a sealing ring is placed, the ring having a front surface protruding from the groove for engagment by the lamp sealing surface, the groove is undercut so as to have a given annular width in an undercut portion and a lesser annular width at a location between the undercut portion and the face of the socket; and a ring installed in the groove consists of a resilient material and has an annular width at a location disposed in the undercut portion of the groove which is greater than the annular width at the aforementioned location.

In a preferred embodiment the groove is undercut along its inner wall only, an annular ridge extending radially outward adjacent the socket face, and the sealing ring consists of an O-ring having a circular cross-section when unstressed, and an inside diameter in the unstressed condition which is less than the outside diameter of the undercut portion.

In a further preferred embodiment the socket comprises a body molded from a thermal curing synthetic material, the groove being molded in the body; the annular ridge having an axial length approximately four times the radial height of the ridge.

According to a further aspect of the invention, a method of manufacturing a lampholder having a configuration as described above comprises injecting a thermal curing synthetic resin into a mold having a movable sleeve, the end of the sleeve protruding into the mold cavity and being shaped so as to define the walls ridge of the undercut groove of the socket, maintaining the mold and injected material at a thermal curing temperature, and withdrawing the sleeve from the mold cavity after the resin has jelled and before it is fully cured.

BRIEF DESCRIPTION OF THE DRAWING

Preferred embodiments of the invention will be described with regard to the drawing, in which.

DESCRIPTION OF THE PREFERRED EMBODIMENTS

Figure 1:
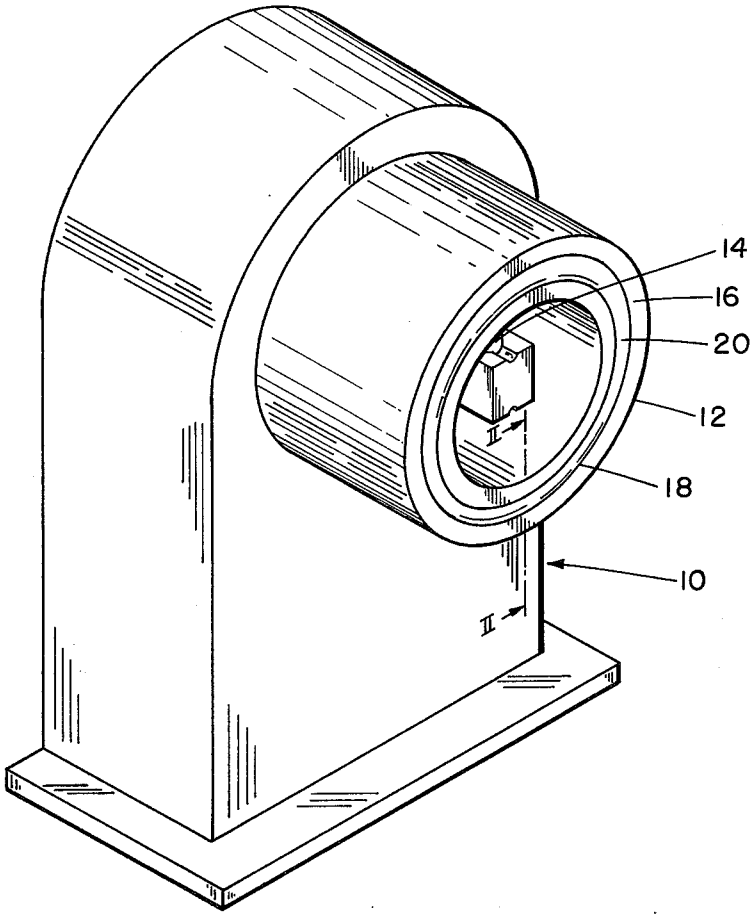
FIG. 1 is a perspective view of a lampholder with a sealing ring according to the invention.

FIG. 1 shows a typical lampholder 10 in which the instant invention may be utilized. Such a lampholder is known, for example, from the Johnson Pat. No. 3,353,140 referred to above. Such a lampholder typically includes a plunger socket 12 which is spring-loaded so as to be compressible upon insertion of a fluorescent tube, the plunger being pressed into the main shall of the lampholder. Electrical connection pins on the fluorescent will depress against the electrical contacts 14 in the plunger, the end wall of the tube being aligned close to the face 16 of the plunger. In accordance with the invention, in the front face 16 there is an undercut groove 18 to be described more particularly with regard to FIG. 2, in which groove a sealing ring 20 is pressed.

Figure 2:
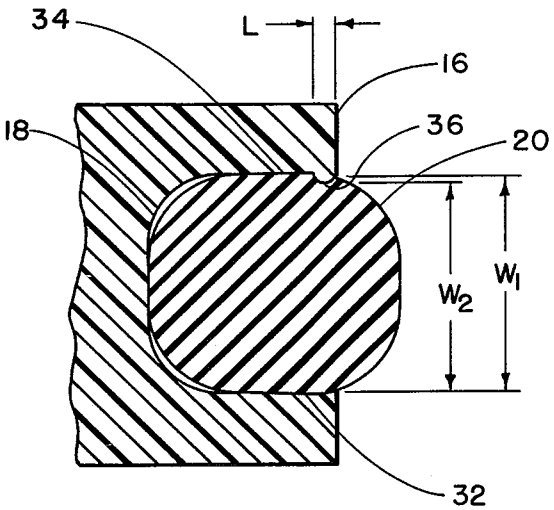
FIG. 2 is an enlarged cross-sectional view of a portion of the lampholder showing the groove and sealing ring.

As shown in the enlarged view of FIG. 2 taken along the section line II—II of FIG. 1, in the front face 16 of the socket a groove 18 is formed having a cylindrical, outer wall 32 extending inward from the face 16, and a cylindrical inner wall portion 34, the distance between these wall portions establishing an annular width $W_1$. To make sure that the O-ring 20 is retained within the groove, an annular ridge 36 extends radially outward between the cylindrical inner wall portion 34 and the front face 16, the height of the ridge being small in proportion with the annular width $W_1$, and defining a second annular width $W_2$. The dimensions or shape of the ridge are not critical, but for convenience in manufacture the ridge preferably has rounded corners, and a height less than its axial length L.

The sealing ring 20 preferably consists of a conventional rubber O-ring having a circular cross-section when unstressed, the thickness of the O-ring (diameter of its cross-section when unstressed) being greater than the depth of the groove 18 and preferably greater than the first annular width $W_1$ so that upon insertion into the groove the O-ring is slightly deformed so as to press against both the undercut cylindrical wall portion 34 and the outer cylindrical wall 32. Retention of the O-ring is improved still more if the circumferential length of the O-ring when unstressed is less than the circumferential length of the groove so that the O-ring is under circumferential tension when installed as well as being under radial compression between the two cylindrical walls. Alternatively however, the O-ring may have a circumferential length when unstressed which is approximately equal to that of the groove, so that upon insertion the ring is deformed only so as to conform to the groove shape and the ridge.

A further aspect of the invention relates to the method of manufacturing the lampholder socket. Undercut grooves are normally avoided in devices which are to be manufactured in quantity, because of the difficulty of molding or machining them, and the fact that they cannot be formed by simple molds when the material to be used is rigid after it has cooled or set. This is particularly true if a device is molded of a material which does not soften upon exposure to elevated temperatures. Lampholders of the sort described by the Nelson and Johnson patents referred to above are made of materials which are thermocuring or thermosetting, rather than thermoplastic. This is because rigidity of lampholders is required both at low and average temperatures, and also at elevated temperatures due to the temperature rise frequently experienced in lighting fixtures.

A technique for molding an undercut groove in a thermoplastic material was developed in the past, for making a splice cap insulator described in the U.S. Patent issued to the instant applicant, No. 2,870,239 issued on Jan. 20, 1959. This patent covers a splice cap insulator made of thermoplastic material, in particular, "nylon" which is resilient over a wide range of elevated temperature. Because of resilience of the heated nylon, a mold sleeve having a flange which defines the undercut portion of the groove can be pulled from the insulator cap without permanently deforming the cap or tearing it at the edge of the groove. However, this technique did not appear applicable to rigid materials suitable for fluorescent lampholders.

The method aspect of the invention covers the steps by which an undercut groove can be molded in a lampholder socket made of materials which are rigid when fully cured, such as urea formaldehyde compounds.

The method of molding a socket in accordance with the invention includes the steps of assembling a mold having a cavity which matches the shape of the socket plunger or other socket shape, the mold including a movable sleeve having a portion projecting into the cavity which has a cross-sectional shape corresponding to that of the desired undercut groove. After a thermocuring compound such as a urea formaldehyde compound has been introduced into the mold, and maintained at an elevated temperature until the compound has jelled but not fully cured, the sleeve is withdrawn from the mold and completion of cure is then permitted. In order to permit easy withdrawal of the sleeve, it has been found desirable that the ridge establishing the undercut have a height which is less than that of the axial length of the ridge, and in a preferred embodiment the length of the ridge is approximately four times that of its height.

For example, in a standard fluorescent fixture a sealing ring may desirably have an inside diameter of approximately three-quarters of an inch, and a length or cross-sectional diameter slightly greater than one-tenth of an inch. For such an O-ring a ridge having a length of one-sixtyfourth of an inch and a height of approximately 0.004 inches provides satisfactory retention of the O-ring, while permitting withdrawal of the sleeve without permanent deformation or damage to the socket.

It would of course be obvious to those skilled in the art that the examples given above are merely one application of the invention. Lampholders are normally used in sets, one having a depressible plunger (the compressible holder) and the other having a fixed socket, perhaps tiltable. A sealing ring would be used in each socket, the socket faces of the two holders having corresponding grooves. The invention is also equally applicable to other styles of fluorescent lampholders such as those described in the Nelson patent referred to above, and to holders for other types of electrical lamp.

Among the other embodiments possible, of course, are grooves of many different shapes. For example, it may be preferred to have ridges on both the inner and outer walls of the groove or on only the outer wall, or to have conical walls of the groove so as to eliminate the ridge per se, the bottom of the groove then having an annular width greater than the groove width at the face of the socket.

It is also clear that the annular grooves are not limited to circular symmetrical grooves, but may have any desired shape which corresponds to the end shape of a lamp having a non-circular cross-section or sealing surface. While conventional O-rings have the advantage of ready availability and low cost, special configurations of sealing ring cross-section may be desirable in special applications, but again using the undercut groove principle of retention.

It is further clear that the cross-section of the ridge in a groove is not critical. A relatively rectangular cross-section will provide tighter retention of the ring, at the expense of greater difficulty in molding. The relative length and height may be varied, although a ratio of at least 2:1 appears desirable so that the ridge shape is not altered unpredictably upon withdrawal of the mold sleeve.

I claim:

1. In a lampholder for a lamp having an annular sealing surface, the lampholder comprising a socket having means for making electrical connection with a lamp inserted into the socket and an annular groove in a planar face of the socket aligned opposite a sealing surface of a lamp inserted into the socket; and a sealing ring arranged in the groove, said ring having a front surface protruding from the groove for engagement by the lamp sealing surface, the improvement wherein said groove is an undercut groove having a first annular width in an undercut portion and a second annular width less than said first annular width at an annular ridge between the undercut portion and the face of the socket; and said ring is an O-ring formed of a resilient material having an annular width at a location disposed in said undercut portion of the groove greater than said second annular width; in an unstressed condition said O-ring having a circular cross-section and an annular width at a location corresponding to said annular ridge greater than said second annular width, whereby said O-ring has an interference fit in said undercut groove and is deformed by said annular ridge.

2. A lampholder as claimed in claim 1 wherein said ring has a circumferential length approximately equal to a corresponding circumferential length of the groove when in an unstressed condition.

3. A lampholder as claimed in claim 1 wherein said ring has a given inside diameter when in an unstressed condition; and wherein said groove undercut portion has a cylindrical outer wall portion extending to said aligned face of the socket, and a cylindrical inner wall portion having a given outside diameter, and between said cylindrical inner wall portion and said aligned face said annular ridge extends radially outward, said second annular width being a space between said ridge and said cylindrical outer wall.

4. A lampholder as claimed in claim 3 wherein said given inside diameter is less than said given outside diameter.

5. A lampholder as claimed in claim 3 wherein said socket comprises a body molded from a thermocuring synthetic material, said groove being molded in said body; and said ridge has a given radial height compared to said cylindrical inner wall portion, and an axial length at least twice said radial height.

6. A lampholder as claimed in claim 5 wherein said ridge axial length is four times said ridge height.

7. A lampholder as claimed in claim 5 wherein said O-ring has an annular width in an unstressed condition greater than said first annular width.

* * * * *